US006391071B1

(12) United States Patent
Krull et al.

(10) Patent No.: US 6,391,071 B1
(45) Date of Patent: May 21, 2002

(54) USE OF HYDROXYL-CONTAINING COPOLYMERS FOR THE PREPARATION OF FUEL OILS HAVING IMPROVED LUBRICITY

(75) Inventors: Matthias Krull, Oberhausen; Markus Kupetz, Dinslaken, both of (DE)

(73) Assignee: Clariant GmbH, Frankfurt (DE)

( * ) Notice: Subject to any disclaimer, the term of this patent is extended or adjusted under 35 U.S.C. 154(b) by 66 days.

(21) Appl. No.: 09/591,236

(22) Filed: Jun. 9, 2000

(30) Foreign Application Priority Data

Jun. 17, 1999 (DE) ..... 199 27 561

(51) Int. Cl.[7] ..... C10L 1/18
(52) U.S. Cl. ..... 44/386; 44/393
(58) Field of Search ..... 44/386, 393

(56) References Cited

U.S. PATENT DOCUMENTS

| | | | | |
|---|---|---|---|---|
| 3,192,165 A | | 6/1965 | Fields et al. | |
| 3,915,668 A | | 10/1975 | Basalay et al. | |
| 4,211,534 A | | 7/1980 | Feldman | |
| 4,670,516 A | | 6/1987 | Sackmann et al. | |
| 4,985,048 A | | 1/1991 | Wirtz et al. | |
| 5,186,720 A | | 2/1993 | Feustel et al. | |
| 5,391,632 A | | 2/1995 | Krull et al. | |
| 5,718,821 A | | 2/1998 | Krull et al. | |
| 5,906,663 A | * | 5/1999 | Brown et al. | 44/393 |
| 6,281,292 B1 | * | 8/2001 | Krull et al. | 525/223 |

FOREIGN PATENT DOCUMENTS

| | | |
|---|---|---|
| DE | 1 594 417 | 5/1970 |
| DE | 126 090 | 6/1977 |
| EP | 0 074 208 | 3/1983 |
| EP | 0 153 176 | 8/1985 |
| EP | 0 154 177 | 9/1985 |
| EP | 0 320 766 | 6/1989 |
| EP | 0 413 279 | 2/1991 |
| EP | 0 523 672 | 1/1993 |
| EP | 0 606 055 | 7/1994 |
| EP | 0 635 558 | 1/1995 |
| EP | 0 680 506 | 11/1995 |
| EP | 0 739 970 | 10/1996 |
| EP | 0 856 533 | 8/1998 |
| WO | WO 95/33805 | 12/1995 |
| WO | WO 96/17905 | 6/1996 |
| WO | WO 96/21709 | 7/1996 |
| WO | WO 99/27037 | 6/1999 |

OTHER PUBLICATIONS

Derwent Patent Family Abstract for DD 126 090.
Derwent Patent Family Abstract for EP 0 856 533.
Ullmann's Encyclopedia of Industrial Chemistry, v. A21, p. 305–431.
N.A. Plate & V.P. Shibaev, J. Polymer Science Macromolecular Reviews, v. 8 1974, p 117–253.
D. Wei, H. A. Spikes, Wear, v. 111 No. 2, 1986, p. 217–235.
Chemical Abstract v. 64, 1966, 3267f, DE 1 594 417 equivalent to Netherlands Application No. 6,413,190.
PCT Search Report.
Derwent Patent Family Abstract for WO 99/27037.

* cited by examiner

*Primary Examiner*—Jacqueline V. Howard
(74) *Attorney, Agent, or Firm*—Richard P. Silverman

(57) ABSTRACT

The present invention relates to the use of oil-soluble copolymers which comprise A) from 5 to 80 mol-% of structural units derived from olefinically unsaturated compounds containing at least one free hydroxyl group, B) from 5 to 95 mol-% of structural units derived from olefinically unsaturated compounds carrying a hydrocarbon radical having at least 6 carbon atoms, and, if desired, C) from 0 to 40 mol-% of further structural units selected from the group consisting of acrylic acid, acrylates, vinyl esters, vinylethane and alkenes, with the proviso that the structural units mentioned under C) are different from the structural units mentioned under A) and B), and have a mean molecular weight Mw of from 500 to 100,000 g/mol and an OH number of from 10 to 300 mg of KOH/g, for improving the lubricity and cold flow properties of middle distillates having a sulfur content of less than 0.5% by weight.

11 Claims, No Drawings

USE OF HYDROXYL-CONTAINING COPOLYMERS FOR THE PREPARATION OF FUEL OILS HAVING IMPROVED LUBRICITY

BACKGROUND OF THE INVENTION

The present invention relates to the use of copolymers containing structural units of olefinically unsaturated, hydroxyl-containing compounds and further olefinically unsaturated compounds containing alkyl radicals for improving the lubricity of middle distillates, and to middle distillate fuel oils containing these additives.

Mineral oils and mineral oil distillates which are used as fuel oils generally contain 0.5% by weight or more of sulfur, which causes the formation of sulfur dioxide on combustion. In order to avoid the environmental pollution resulting therefrom, the sulfur content of fuel oils is continually being reduced. The EN 590 standard relating to diesel fuels currently prescribes a maximum sulfur content of 500 ppm in Germany. In Scandinavia, fuel oils containing less than 200 ppm and in exceptional cases containing less than 50 ppm of sulfur are already in use. These fuel oils are generally prepared by hydrorefining the fractions obtained from crude oil by distillation. During the desulfurization, however, other substances which give the fuel oils natural lubricity are also removed. These substances include, inter alia, polyaromatic and polar compounds.

However, it is now been found that the friction- and wear-reducing properties of fuel oils worsen with increasing degree of desulfurization. These properties are frequently so inadequate that signs of corrosion must be expected after only a short time on the materials lubricated by the fuel, for example the distributor injection pumps of diesel engines. The further lowering of the 95% distillation point to below 370° C., in some cases to below 350° C. or below 330° C., which has in the meantime been adopted in Scandinavia intensifies this problem further.

Approaches which claim to be a solution to this problem have therefore been described in the prior art (so-called lubricity additives).

EP-A-0 680 506 discloses esters of carboxylic acids having 2 to 50 carbon atoms as additives for improving the lubricity of low-sulfur middle distillates containing less than 0.5% by weight of S.

DD-126 090 discloses lubricity-improving additives containing copolymers of ethylene and unsaturated carboxylic esters, preferably vinyl acetate, which are added to the fuels in amounts of from 0.01 to 0.5% by weight.

EP-A-0 764 198 discloses additives which improve the lubricity of fuel oils and comprise polar nitrogen compounds based on alkylamines or alkylammonium salts containing alkyl radicals having 8 to 40 carbon atoms.

DE-A-15 94 417 discloses additives for improving the lubricity of oleophilic liquids containing esters of glycols and dicarboxylic acids having at least 11 carbon atoms.

EP-A-0 635 558 discloses diesel oils having sulfur contents of below 0.2% by weight and aromatics contents of below 30% by weight. These diesel oils are mixed with from 100 to 10,000 ppm of $C_1$–$C_5$-alkyl esters of unsaturated straight-chain $C_{12}$–$C_{22}$-fatty acids derived from oilseed as additives.

EP-A-0 074 208 discloses middle and heavy distillates which have been mixed with copolymers of ethylene and oxyalkylated acrylates or ethylene and vinyl esters of saturated and unsaturated carboxylic acids as additives.

EP-A-0 856 533 discloses copolymers based on vinyl esters of carboxylic acids, vinylaromatic hydrocarbons, hydroxyl-functional unsaturated monomers and further polymerizable polymers. The polymers have OH numbers of 110–170 mg of KOH/g and have molecular weights of 1500–8000 g/mol. However, the polymers are used, according to the disclosure content of the document, for the production of surface coatings for paints. Use in connection with fuel oils is not disclosed.

U.S. Pat. No. 3,915,668 discloses terpolymers of ethylene, 10–25% by weight of $C_1$–$C_8$-alkylvinyl esters and 10–30% by weight of dialkylvinylcarbinol and their use for improving the cold-flow properties of crude oils and residual oils. The suitability of such terpolymers for improving the lubricity of distillate fuels is not disclosed.

SUMMARY OF THE INVENTION

The object of the present invention was to find additives which result in an improvement in lubricity in middle distillates which have been substantially freed from sulfur and aromatic compounds. At the same time, these additives should also have a favorable effect on the cold-flow properties of these middle distillates.

Surprisingly, it is been found that oil-soluble copolymers of ethylenically unsaturated compounds carrying one or more hydroxyl groups and ethylenically unsaturated compounds containing hydrocarbon groups having at least 6 carbon atoms impart the requisite properties to the fuel oils to which they are added as additives.

DESCRIPTION OF THE PREFERRED EMBODIMENTS

The invention thus relates to the use of oil-soluble copolymers which comprise

A) from 5 to 80 mol-% of structural units derived from olefinically unsaturated compounds containing at least one free hydroxyl group, B) from 5 to 95 mol-% of structural units derived from olefinically unsaturated compounds carrying a hydrocarbon radical having at least 6 carbon atoms, and, if desired, C) from 0 to 40 mol-% of further structural units selected from the group consisting of acrylic acid, acrylates, vinyl esters, vinylethane and alkenes, with the proviso that the structural units mentioned under C) are different from the structural units mentioned under A) and B), and have a mean molecular weight Mw of from 500 to 100,000 g/mol and an OH number of from 10 to 300 mg of KOH/g, for improving the lubricity and cold flow properties of middle distillates having a sulfur content of less than 0.5% by weight.

The invention furthermore relates to middle distillate fuel oils having a sulfur content of less than 0.5% by weight which contain copolymers of the type defined above.

In a preferred embodiment of the invention, the copolymer has an OH number of from 20 to 250, in particular from 25 to 200, mg of KOH/g. In a further preferred embodiment, the copolymer has a mean molecular weight Mw of from 700 to 10,000 g/mol. In a further preferred embodiment, the proportion of the structural units (A) is from 10 to 70 mol-%, in particular from 15 to 60 mol-%.

The olefinically unsaturated compounds which make up the copolymers (A) are preferably vinyl esters, acrylates, mono- and diesters of ethylenically unsaturated carboxylic acids, methacrylates, alkyl vinyl ethers and/or alkenes carrying hydroxyalkyl, hydroxyalkenyl, hydroxycycloalkyl or hydroxyaryl radicals. These radicals contain at least one hydroxyl group, which can be in any desired position of the radical, but is preferably at the chain end (co-position) or in the para-position in the case of ring systems.

The vinyl esters are preferably those of the formula 1

$$CH_2=CH—OCOR^1 \quad (1)$$

in which $R^1$ is $C_1$–$C_{30}$-hydroxyalkyl, preferably $C_1$–$C_{12}$-hydroxyalkyl, especially $C_2$–$C_6$-hydroxyalkyl, and the corresponding hydroxyoxalkyl radicals. Suitable vinyl esters include 2-hydroxyethyl vinyl ester, α-hydroxypropyl vinyl ester, 3-hydroxypropyl vinyl ester and 4-hydroxybutyl vinyl ester, and diethylene glycol monovinyl ester.

The acrylates are preferably those of the formula 2

$$CH_2=CR^2—COOR^3 \quad (2)$$

in which $R^2$ is hydrogen or methyl, and $R^3$ is $C_1$–$C_{30}$-hydroxyalkyl, preferably $C_1$–$C_{12}$-hydroxyalkyl, especially $C_2$–$C_6$-hydroxyalkyl, and the corresponding hydroxyoxalkyl radicals. Suitable acrylates include hydroxyethyl acrylate, hydroxyethyl methacrylate, 2-hydroxy-propyl acrylate, 3-hydroxypropyl acrylate, 3-hydroxypropyl methacrylate, hydroxyisopropyl acrylate, 4-hydroxybutyl acrylate and glycerol monoacrylate. The corresponding esters of methacrylic acid, and esters of ethylenically unsaturated dicarboxylic acids, such as maleic acid, fumaric acid and itaconic acid, with diols are just as suitable.

The alkyl vinyl ethers are preferably compounds of the formula 3

$$CH_2=CH—OR^4 \quad (3)$$

in which $R^4$ is $C_1$–$C_{30}$-hydroxyalkyl, preferably $C_1$–$C_{12}$-hydroxyalkyl, especially $C_2$–$C_6$-hydroxyalkyl, and the corresponding hydroxyoxalkyl radicals. Suitable alkyl vinyl ethers include 2-hydroxyethylvinylether, hydroxypropyl vinyl ether, hexanediol monovinyl ether, 4-hydroxybutyl vinyl ether, diethylene glycol monovinyl ether and cyclohexanedimethanol monovinyl ether.

The alkenes are preferably monounsaturated hydroxyhydrocarbons having 3 to 30 carbon atoms, in particular 4 to 16 carbon atoms, especially 5 to 12 carbon atoms. Suitable alkenes include dimethylvinylcarbinol (=2-methyl-3-buten-2-ol), allyloxypropanediol, 2-butene-1,4-diol, 1-buten-3-ol, 3-buten-1-ol, 2-buten-1-ol, 1-penten-3-ol, 1-penten-4-ol, 2-methyl-3-buten-1-ol, 1-hexen-3-ol, 5-hexen-1-ol and 7-octene-1,2-diol.

Preferred comonomers (B) are olefinically unsaturated compounds carrying hydrocarbon radicals having at least 6 carbon atoms (excluding the olefinic group necessary for the polymerization). These hydrocarbon radicals can be linear, branched, cyclic and/or aromatic. Besides hydrocarbon groups, they can also carry secondary amounts of further functional groups containing heteroatoms, such as, for example, nitro, halogen, cyano or amino groups, so long as these do not impair the oil solubility. These are preferably monomers from the following groups:

B1) Vinyl esters of carboxylic acids having at least 7 carbon atoms, such as, for example, vinyl octanoate, vinyl 2-ethylhexanoate, vinyl laurate, vinyl octadecanoate, vinyl neononanoate, vinyl neodecanoate, vinyl neoundecanoate or vinyl neododecanoate.

B2) (Meth)acrylic esters with alcohols having at least 6 carbon atoms, such as, for example, octyl acrylate, 2-ethylhexyl acrylate, decyl acrylate, undecenyl acrylate, dodecyl acrylate, tetradecyl acrylate, hexadecyl acrylate, oleyl acrylate, behenyl acrylate, and the corresponding esters of methacrylic acid, and esters of ethylenically unsaturated dicarboxylic acids, such as maleic acid, fumaric acid or itaconic acid B3) Alkyl vinyl ethers carrying at least one $C_6$-alkyl radical, such as, for example, octadecyl vinyl ether B4) Olefins and vinylaromatic compounds having chain lengths of at least 6 carbon atoms, such as, for example, 1-octene, 1-decene, 1-dodecene, 1-tetradecene, 1-hexadecene, 1-octadecene, 1-eicosene, technical grade ∀-olefin cuts, such as $C_{20}$–$C_{24}$-∀-olefin, $C_{24}$–$C_8$-∀-olefin, $C_{30}$+-∀-olefin, styrene, ∀-methylstyrene and p-methoxystyrene.

It is possible to use either individual comonomers B or mixtures of different comonomers of the individual and/or different monomers B1) to B4). Particularly preferred comonomers (B) are the above-mentioned olefinically unsaturated compounds from groups B1) to B4) containing hydrocarbon radicals having at least 8 carbon atoms. Preferably at least 10 mol-%, particularly preferably at least 25 mol-%, especially more than 50 mol-%, of the monomers (B) carry linear hydrocarbon radicals. The proportion of comonomers (B) in the polymers according to the invention is preferably from 30 to 90 mol-%, in particular from 40 to 80 mol-%.

As further comonomers C), up to 40 mol-% of acrylic acid or methacrylic acid, acrylates, such as methyl acrylate, ethyl acrylate or butyl acrylate, and the corresponding methacrylic esters, vinyl esters, such as vinyl acetate, vinyl propionate or vinyl hexanoate, or olefins, such as ethylene, propene, butene, isobutene, pentene, hexene, 4-methylpentene, diisobutylene or norbornene, can be copolymerized if desired. It is likewise possible for nitrogen-containing monomers, such as, for example, a) aminoalkyl acrylates and methacrylates, such as, for example, aminoethyl acrylate, aminopropyl acrylate, amino-n-butyl acrylate, N-methylaminoethyl acrylate, N,N-dimethylaminoethyl acrylate, N,N-diethylaminoethyl acrylate, N,N-dimethylaminopropyl acrylate or N,N-diethylaminopropyl acrylate, and the corresponding methacrylates, b) alkylacrylamides and methacrylamides, such as, for example, ethylacrylamide, butylacrylamide, N-octylacrylamide, N-propyl-N-methoxyethylacrylamide, N-acryloylphthalimide, N-acryloylsuccinimide or N-methylolacrylamide, and the corresponding methacrylamides, c) vinylamides, such as, for example, N-vinyl-N-methylacetamide or N-vinylsuccinimide, d) aminoalkyl vinyl ethers, such as, for example, aminopropyl vinyl ether, diethylaminoethyl vinyl ether or dimethylaminopropyl vinyl ether, e) allylamine, N-allyl-N-methylamine, N-allyl-N-ethylamine or diallylamine f) heterocyclic compounds carrying a vinyl group, such as, for example, N-vinylpyrrolidone, methylvinylimidazole, 2-vinylpyridine, 4-vinylpyridine, 2-methyl-5-vinylpyridine, vinylcarbazole, vinylimidazole, N-vinyl-2-piperidone or N-vinylcaprolactam, to be copolymerized.

In order to achieve easier handling and better solubility of the additives, preferably up to 20 mol-%, in particular up to 10 mol-%, of the comonomers B) and, if used, C) contain branched alkyl chains. Oligomers and polymers of lower olefins, such as, for example, polypropylene, polybutene and polyisobutylene, are also suitable here, preference being given to oligomers having a high content of terminal double bonds (>50 mol-%, preferably >70 mol-%, in particular >75 mol-%).

The melt viscosities of the copolymers at 140° C. are preferably less than 10,000 mPas, in particular from 10 to 2000 mPas, especially from 15 to 1000 mPas. For the purposes of the invention, "oil-soluble" is taken to mean that at least 10% by weight, preferably at least 1% by weight, in particular at least 0.1% by weight, of the additive forms a clear solution in the middle distillates to which the additive is to be added.

The copolymerization of the copolymers is carried out by known batch or continuous polymerization processes (cf. in this respect, for example, Ullmanns Encyclopädie der Technischen Chemie [Ullmann's Encyclopaedia of Industrial Chemistry], 5th Edition, Vol. A21, pages 305 to 413). Suitable polymerizations are in solution, in suspension, in the gas phase, and precipitation and bulk polymerization. Preference is given to bulk and solution polymerization. The reaction of the comonomers is initiated by free radical-forming initiators (free-radical chain initiators). This class of substances includes, for example, oxygen, hydroperoxides, peroxides and azo compounds, such as cumene hydroperoxide, t-butyl hydroperoxide, dilauroyl peroxide, dibenzoylperoxide, bis(2-ethylhexyl) peroxydicarbonate, t-butyl permaleate, t-butylperpivalate, t-butyl perbenzoate, dicumyl peroxide, t-butyl cumyl peroxide, di(t-butyl) peroxide, 2,2'-azobis(2-methylpropionitrile) and 2,2'-azobis-(2-methylbutyronitrile). The initiators are employed individually or as a mixture of two or more substances in amounts of from 0.01 to 20% by weight, preferably from 0.05 to 10% by weight, based on the copolymer mixture.

The polymerization is generally carried out at temperatures of 40–300° C., preferably at 80–250° C., it being advantageous to work under pressure if monomers and/or solvents having boiling points below the polymerization temperature are used. The polymerization is advantageously carried out with exclusion of air, for example under nitrogen, since oxygen has an adverse effect on the polymerization. When selecting the initiator or initiator system, it is advantageous to ensure that the half-value period of the initiator or initiator system is less than 3 hours at the selected polymerization temperature. It is preferably between 0.5 minute and one hour.

The desired molecular weight of the copolymers is obtained for a given composition of the comonomer mixture by varying the reaction parameters concentration and temperature. In order to produce low-molecular-weight copolymers, it is furthermore possible to add moderators. Suitable molecular weight regulators are, for example, aldehydes, ketones, alcohols and organosulfur compounds, such as mercaptoethanol, mercaptopropanol, mercaptoacetic acid, mercaptopropionic acid, tert-butyl mercaptan, n-butyl mercaptan, n-octyl mercaptan, tert-dodecyl mercaptan and n-dodecyl mercaptan. Depending on the target viscosity, the moderators are used in amounts of up to 20% by weight, preferably from 0.05 to 10% by weight, based on the copolymer mixture.

Suitable apparatuses for the polymerization are, for example, conventional stirred reactors having, for example, anchor, paddle, impeller and multi-stage impulse countercurrent agitators, and for continuous preparation stirred reactor cascades, stirred reactors or static mixers.

Besides solvent-free bulk polymerization, the preferred process for the preparation of the copolymers according to the invention is solution polymerization. It is carried out in the solvents in which the monomer and the copolymers formed are soluble. Suitable solvents here are all those which satisfy this criterion and do not undergo any reactions with the monomers and the copolymers formed. These are, for example, organic, preferably aromatic solvents, such as cumene, toluene, xylene, ethylbenzene or alternatively commercial solvent mixtures, such as ®Solvent Naphtha, ®Shellsol AB or ®Solvesso 150 or 200.

In the preparation, all monomers can be initially introduced and polymerized by addition of a free-radical chain initiator and supply of heat.

However, it is advantageous to initially introduce the solvent and, if desired, a part-amount of the monomers (for example about 5–20%) and to meter the remainder of the monomer mixture in together with the initiator and, if used, co-initiator and regulator.

The concentration of the monomers to be polymerized is from 20 to 95% by weight, preferably from 50 to 90% by weight.

The solid terpolymer can be isolated by precipitation using suitable non-solvents, such as acetone or methanol, or by evaporation of the solvent. However, it is advantageous to select a solvent for the polymerization in which the polymer can be employed directly in accordance with the invention.

Furthermore, the lubricity of oils can be improved in the manner according to the invention by mixing them with copolymers obtained by oxyalkylation of copolymers containing acid groups. Copolymers which are suitable for this purpose are, for example, those of acrylic acid, methacrylic acid, itaconic acid, fumaric acid, maleic acid or maleic anhydride with the comonomers B and, if used, C. In order to prepare an additive which improves the lubricity of oils, these copolymers containing acid groups are oxyalkylated at the acid groups using $C_1$- to $C_{10}$-alkylene oxides. Preferred alkylene oxides are ethylene oxide, propylene oxide and butylene oxide. The oxyalkylation can preferably be carried out using from 0.5 to 10 mol. in particular from 1 to 5 mol, especially from 1 to 2 mol, of alkylene oxide per mol of acid groups.

The copolymers according to the invention are added to mineral oils or mineral oil distillates in the form of solutions or dispersions containing from 10 to 90% by weight, preferably 20–80% by weight, of the copolymers. Suitable solvents or dispersion media are aliphatic and/or aromatic hydrocarbons or hydrocarbon mixtures, for example benzine fractions, kerosene, decane, pentadecane, toluene, xylene, ethylbenzene or commercial solvent mixtures, such as solvent naphtha, ®Shellsol AB, ®Solvesso 150, ®Solvesso 200, ®Exxsol, ®ISOPAR and ®Shellsol D grades. Other suitable solvents are oil-soluble esters of native origin, such as, for example, triglycerides of fatty acids and methyl esters of fatty acids, such as methyl esters of rapeseed oil acid and soya oil acid. Mineral oils or mineral oil distillates whose lubricity and/or cold-flow properties have been improved by the copolymers contain from 0.001 to 2, preferably from 0.005 to 0.5% by weight of copolymer, based on the distillate.

The copolymers according to the invention can furthermore be used in the form of mixtures consisting of copolymers of the claimed type, but of different qualitative and/or quantitative composition and/or of different viscosity (measured at 140° C.). The mixing ratio (in parts by weight) between the copolymers can be varied over a broad range and can be, for example, from 20:1 to 1:20, preferably from 10:1 to 1:10. In this way, the additives can be matched specifically to individual requirements.

In order to produce additive packages for specific problem solutions, the copolymers according to the invention can also be employed together with one or more oil-soluble co-additives which per se improve the cold-flow properties and/or lubricity of crude oils, lubricating oils or fuel oils. Examples of such co-additives are ethylene copolymers or terpolymers containing vinyl acetate, polar compounds which effect paraffin dispersion (paraffin dispersants), comb polymers, alkylphenol-aldehyde resins and oil-soluble amphiphiles.

Thus, mixtures of the terpolymers with copolymers containing from 10 to 40% by weight of vinyl acetate and from 60 to 90% by weight of ethylene have proven highly successful. In accordance with a further refinement of the invention, the terpolymers prepared in accordance with the invention are employed as a mixture with ethylenevinyl acetate-vinyl neononanoate or ethylene-vinyl acetate-vinyl neodecanoate terpolymers for improving the flow properties of mineral oils or mineral oil distillates. The terpolymers of vinyl neononanoate or vinyl neodecanoate contain, in addition to ethylene, from 10 to 35% by weight of vinyl acetate and from 1 to 25% by weight of the respective neo compounds. Further preferred copolymers contain, in addition to ethylene and from 10 to 35% by weight of vinyl esters, from 0.5 to 20% by weight of an olefin, such as diisobutylene, 4-methylpentene or norbornene. The mixing ratio between the terpolymers prepared in accordance with the invention and the ethylene-vinyl acetate copolymers described above or the terpolymers of ethylene, vinyl acetate and the vinyl esters of neononanoic acid or neodecanoic acid is (in parts by weight) from 20:1 to 1:20, preferably from 10:1 to 1:10.

For use as a flow improver and/or lubricity additive, the copolymers according to the invention can furthermore be employed as a mixture with paraffin dispersants. These additives reduce the size of the paraffin crystals and mean that the paraffin particles do not separate out, but instead remain dispersed in colloidal form with significantly reduced sedimentation tendency. Furthermore, they increase the lubricity of the copolymers according to the invention. Paraffin dispersants which have proven successful are oil-soluble polar compounds containing ionic or polar groups, for example amine salts and/or amides obtained by reaction of aliphatic or aromatic amines, preferably long-taking aliphatic amines, with aliphatic or aromatic mono-, di-, tri- or tetracarboxylic acids or anhydrides thereof (cf. U.S. Pat. No 4,211,534). Other paraffin dispersants are copolymers of maleic anhydride and α,β-unsaturated compounds, which can, if desired, be reacted with primary monoalkylamines and/or aliphatic alcohols (cf. EP 0 154 177), the products of the reaction of alkenylspirobislactones with amines (cf. EP 0 413 279 B1) and, in accordance with EP 0 606 055 A2, products of the reaction of terpolymers based on α, β-unsaturated dicarboxylic anhydrides, α,β-unsaturated compounds and polyoxyalkylene ethers of lower unsaturated alcohols. Alkylphenol-aldehyde resins are also suitable as paraffin dispersants.

Thus, the copolymers according to the invention can be employed as a mixture with alkylphenol-formaldehyde resins. In a preferred embodiment of the invention, these alkylphenol-formaldehyde resins are those of the formula 5

(5)

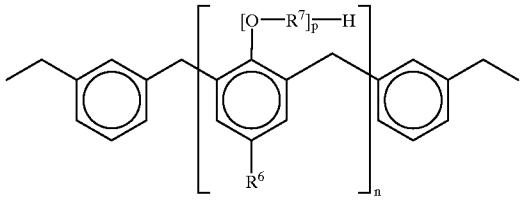

which $R^6$ is $C_4$–$C_{50}$-alkyl or -alkenyl, $R^7$ is ethoxy and/or propoxy, n is a number from 5 to 100, and p is a number from 0 to 50.

Finally, in a further proven variant of the invention, the copolymers according to the invention are used together with comb polymers. These are taken to mean polymers in which hydrocarbon radicals having at least 8, in particular at least 10, carbon atoms are bonded to a polymer backbone. These are preferably homopolymers whose alkyl side chains contain at least 8 and in particular at least 10 carbon atoms. In the case of copolymers, at least 20%, preferably at least 30%, of the monomers have side chains (Comb-like Polymers—Structure and Properties; N. A. Platéand V. P. Shibaev, J. Polym. Sci. Macromolecular Revs. 1974, 8, 117 ff). Examples of suitable comb polymers are, for example, fumarate-vinyl acetate copolymers (cf. EP 0 153 176 A1), copolymers of a $C_6$- to $C_{24}$-α-olefin and an N—$C_6$- to $C_{22}$-alkylmaleimide (cf. EP 0 320 766), furthermore esterified olefin-maleic anhydride copolymers, polymers and copolymers of α-olefins, and esterified copolymers of styrene and maleic anhydride.

Comb polymers can be described, for example, by the formula

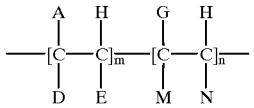

in which

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8–150 carbon atoms;

R" is a hydrocarbon chain having 1 to 10 carbon atoms;

m is a number between 0.4 and 10; and n is a number between 0 and 0.6.

The mixing ratio (in parts by weight) between the copolymers prepared in accordance with the invention and paraffin dispersants, resins or comb polymers is in each case from 1:10 to 20:1, preferably from 1:1 to 10:1.

In order to optimize the lubricity, the copolymers according to the invention can be employed as a mixture with further lubricity additives. Lubricity additives which have proven successful are preferably fatty alcohols, fatty acids and dimeric fatty acids, and their esters and partial esters with glycols (in accordance with DE-A-15 94 417), polyols, such as glycerol (in accordance with EP-A-0 680 506 and EP-A-0 739 970) or hydroxylamines (in accordance with EP-A-0 802 961).

The copolymers according to the invention are suitable for improving the lubricating properties and low-temperature properties of animal, vegetable or mineral oils. They are particularly suitable for use in middle distillates. The term "middle distillates" denotes, in particular, mineral oils which are obtained by distillation of crude oil and boil in the range from 120 to 450° C., for example kerosene, jet fuel, diesel and heating oil. The copolymers according to the invention are preferably used in middle distillates which contain 0.5% by weight or less of sulfur, especially preferably less than 500 ppm sulfur, in particular less than 200 ppm of sulfur, and in specific cases less than 50 ppm of sulfur. These are generally middle distillates which have been subjected to hydrorefining and contain only small proportions of polyaromatic and polar compounds which give them a natural lubricity. The copolymers according to the invention are furthermore used in middle distillates which have a 95% distillation point of below 370° C., in particular 350° C. and in special cases below 330° C. They can also be employed as components in lubricating oils.

The polymers can be used alone or alternatively together with other additives, for example with other pour point depressants or dewaxing auxiliaries, with corrosion inhibitors, antioxidants, sludge inhibitors, dehazers and additives for improving the cloud point.

The effectiveness of the copolymers according to the invention as lubricity additives and cold-flow improvers is explained in greater detail by the examples below.

EXAMPLES

Various copolymers were prepared by solution polymerization with free-radical initiation by organic peroxides. The solvents used were high-boiling aromatic hydrocarbon mixtures or the a-olefins also employed as comonomers.

The hydroxyl-functional comonomers are determined by measuring the OH number by reacting the polymer with excess acetic anhydride and then titrating the acetic acid formed with KOH.

The viscosity is determined in accordance with ISO 3219 (B) using a rotational viscometer (Haake RV 20) with a plate-and-cone measurement system at 140° C.

In the characterization of the additives employed, the percentages relate to mol-%. Tallow fatty alcohol and behenyl alcohol are fatty alcohol mixtures of natural origin and consist principally of $C_{16/18}$-OH or $C_{18/20/22}$-OH. All additives are employed as 50% solutions in solvent naphtha or kerosene in order to improve handling.

TABLE 1

Characterization of the additives A employed

| Additive | Monomer A | Monomer(s) B | $V_{140}$ [mPas] | OH No. |
|---|---|---|---|---|
| A1 | 24% hydroxyethyl methacrylate | 39% octadecene 37% vinyl neodecanoate | 54 | 67 |
| A2 | 23% hydroxyethyl methacrylate | 41% octadecene 36% vinyl neodecanoate | 37 | 62 |
| A3 | 33% hydroxyethyl methacrylate | 67% octadecyl acrylate | 47 | 71 |
| A4 | 19% hydroxyethyl methacrylate | 81% vinyl neodecanoate | 35 | 58 |
| A5 | 48% hydroxyethyl methacrylate | 52% octadecyl acrylate | 43 | 116 |
| A6 | 55% hydroxyethyl methacrylate | 45% octadecene | 75 | 198 |
| A7 | 38% hydroxyethyl methacrylate | 62% oleyl acrylate | 70 | 86 |
| A8 | 28% allyloxypropanediol | 72% octadecyl acrylate | 24 | 116 |
| A9 | 12% ethylene glycol monovinyl ether | 73% octadecyl acrytate 15% vinyl acetate | 82 | 25 |
| A10 | 25% hydroxybutyl monovinyl ether | 75% octadecyl vinyl ether | 54 | 70 |
| A11 | 37% hydroxypropyl acrylate | 63% tallow fatty alkyl acrylate | 37 | 82 |
| A12 | 41% hydroxyethyl methacrylate | 59% behenyl acrylate | 115 | 90 |
| A13 | 20% dimethylinylcarbinol | 71% hexadecene 9% poly(isobutylene) with Mw 1000 | 69 | 42 |

TABLE 2

Characterization of the test oils:
The boiling characteristics are determined in accordance with ASTM D-86, the CFPP value in accordance with EN 116 and the cloud point in accordance with ISO 3015.

| | Test Oil 1 | Test Oil 2 |
|---|---|---|
| Start of boiling [° C.] | 182 | 173 |
| 20% [° C.] | 202 | 221 |
| 30% [° C.] | 208 | 234 |
| 90% [° C.] | 286 | 329 |
| 95% [° C.] | 302 | 353 |
| Cloud point [° C.] | −29 | −8.4 |
| CFPP [° C.] | −32 | −12 |
| S content [ppm] | 3 | 267 |
| Density [g/cm$^3$] | 0.819 | 0.836 |
| Wear scar [$\mu$m] | 609 | 576 |

Lubricity in Middle Distillates

The lubricity of the additives was measured on additive-containing oils at 60° C. using an HFRR instrument from PCS Instruments. The high frequency reciprocating rig test (HFRR) is described in D. Wei, H. Spikes, Wear, Vol.111, No. 2, p. 217,1986. The results are given as coefficient of friction and wear scar. A low coefficient of friction and a low wear scar indicate good lubricity.

TABLE 3

Wear scar in Test Oil 1

| Example | Additive | Wear scar | Film | Friction |
|---|---|---|---|---|
| B1 | 250 ppm A1 | 309 μm | 87% | 0.16 |
| B2 | 250 ppm A2 | 312 μm | 80% | 0.17 |
| B3 | 500 ppm A3 | 242 μm | 89% | 0.15 |
| B4 | 500 ppm A4 | 438 μm | 57% | 0.23 |
| B5 | 250 ppm A5 | 260 μm | 89% | 0.16 |
| B6 | 200 ppm A6 | 236 μm | 88% | 0.15 |
| B7 | 150 ppm A6 | 431 μm | 49% | 0.22 |
| B8 | 200 ppm A7 | 334 μm | 76% | 0.17 |
| B9 | 250 ppm A8 | 298 μm | 87% | 0.16 |
| B10 | 400 ppm A9 | 321 μm | 78% | 0.19 |
| B11 | 200 ppm A10 | 275 μm | 90% | 0.15 |
| B12 | 400 ppm A11 | 340 μm | 74% | 0.19 |
| B13 | 250 ppm A12 | 263 μm | 90% | 0.15 |
| B14 | 400 ppm A13 | 361 μm | 70% | 0.16 |

Paraffin Dispersion in Middle Distillates

The following experiment was carried out using a German winter diesel fuel (Test Oil 2). The middle distillate was mixed at room temperature with 200 ppm of a 57% dispersion of a commercially available flow improver (ethylene-vinyl acetate copolymer containing 31% by weight of vinyl acetate and having a melt viscosity, measured at 140° C., of 170 mpas), and the amounts shown in Table 4 of the additives held at 60° C., warmed to 40° C. over the course of 15 minutes with occasional shaking and subsequently cooled to room temperature. The CFPP value of the middle distillate containing these additives was determined in accordance with EN 116.

The samples containing additives were cooled to −13° C. in 200 ml measuring cylinders in a refrigerator at −2° C./hour, and stored at this temperature for 16 hours. The volume and appearance of both the sediment (paraffin phase) and the supernatant oil phase were determined and assessed visually. A low sediment amount and a cloudy oil phase indicate good paraffin dispersion.

In addition, the lower 20% by volume were isolated and their cloud point determined. An only small deviation of the cloud point of the lower phase ($CP_{KS}$) from the blank value of the oil indicates good paraffin dispersion.

TABLE 4

Dispersion action in Test Oil 2

| Additive | CFPP | $CP_{KS}$ | ΔCP | Visual assessment |
|---|---|---|---|---|
| — | −22 | +3.8 | 12.2 | clear; 12% sediment |
| 150 ppm A3 | −27 | −6.5 | 1.9 | Cloudy, no sediment |
| 100 ppm A5 | −28 | −4.8 | 3.6 | Cloudy, 25% sediment |

List of Trade Names Used

| | |
|---|---|
| Solvent Naphtha ® Shellsol AB ® Solvesso 150 | aromatic solvent mixtures having a boiling range of from 180 to 210° C. |

-continued

| | |
|---|---|
| ® Solvesso 200 | aromatic solvent mixture having a boiling range of from 230 to 287° C. |
| ® Exxsol | dearomatized solvents in various boiling ranges, for example ® Exxsol D60: 187 to 215° C. |
| ® ISOPAR (Exxon) | isoparaffinic solvent mixtures in various boiling ranges, for example ® ISOPAR L: 190 to 210° C. |
| ® Shellsol D | principally aliphatic solvent mixtures in various boiling ranges |

What is claimed is:

1. A method for improving the lubricity of a low-sulfur middle distillate oil having a sulfur content less than 0.5 wt-% sulfur, said process comprising combining the low-sulfur middle distillate oil with less than 0.5 weight percent of an oil-soluble copolymer comprising:

A) from 5 to 80 mol-% of structural units derived from olefinically unsaturated compounds containing at least one free hydroxyl group, B) from 5 to 95 mol-% of structural units derived from olefinically unsaturated compounds carrying a hydrocarbon radical having at least 6 carbon atoms, and, if desired, C) from 0 to 40 mol-% of further structural units selected from the group consisting of acrylic acid, acrylates, vinyl esters, vinylethane and alkenes, with the proviso that the structural units mentioned under C) are different from the structural units mentioned under A) and B), and have a mean molecular weight Mw of from 500 to 100,000 g/mol and an OH number of from 10 to 300 mg of KOH/g.

2. The process of claim 1, where the copolymer has an OH number of from 20 to 250 mg of KOH/g.

3. The process of claim 1, where the copolymer has a mean molecular weight Mw of from 700 to 10,000 g/mol.

4. The process of claim 1, where the proportion of the structural units (A) is from 10 to 70 mol-%, in particular from 15 to 60 mol-%.

5. The process of claim 1, where the proportion of the comonomers (B) in the polymers according to the invention is from 30 to 90 mol-%, in particular from 40 to 80 mol-%.

6. The process of claim 1, where up to 20 mol-%, in particular up to 10 mol-%, of the comonomers B) and, if used, C), contain branched alkyl chains.

7. The process of claim 1, where the melt viscosities of the copolymers at 140° C. are from 10 to 1000 mPas.

8. A low-sulfur middle distillate oil produced by the process of claim 1.

9. The process of claim 1 wherein the low-sulfur middle distillate oil is combined with less than 500 ppm weight of the oil-soluble copolymer.

10. The process of claim 1, wherein the proportion of the structural units (A) is from 15 to 60 mol-%.

11. The process of claim 1, wherein the proportion of the comonomers (B) in the polymers according to the invention is from 40 to 80 mol-%.

* * * * *